US005803364A

United States Patent [19]

Martin

[11] Patent Number: 5,803,364

[45] Date of Patent: Sep. 8, 1998

[54] AXIALLY SEPARABLE SELF-CLEANING NOZZLE

[76] Inventor: Javier Martin, Utmarksvägen 27, Gävle S-802 91, Sweden

[21] Appl. No.: 557,041

[22] PCT Filed: Jun. 30, 1994

[86] PCT No.: PCT/SE94/00648

§ 371 Date: Dec. 8, 1995

§ 102(e) Date: Dec. 8, 1995

[87] PCT Pub. No.: WO95/01227

PCT Pub. Date: Jan. 12, 1995

[30] Foreign Application Priority Data

Jul. 2, 1993 [SE] Sweden ..... 9302283

[51] Int. Cl.[6] ..... B05B 15/02

[52] U.S. Cl. ..... 239/107; 239/455

[58] Field of Search ..... 239/106, 107, 239/437, 451, 455; 138/45, 46; 251/63, 263

[56] References Cited

U.S. PATENT DOCUMENTS

| | | | |
|---|---|---|---|
| 120,120 | 10/1871 | Stewart | 239/455 |
| 2,484,628 | 10/1949 | Valley | 251/263 X |
| 2,593,357 | 4/1952 | Spooner | 239/451 |
| 3,936,002 | 2/1976 | Geberth, Jr. | 239/455 |
| 4,220,286 | 9/1980 | Geberth, Jr. | 239/455 |
| 4,250,211 | 2/1981 | Damrau et al. | 427/356 |
| 4,269,355 | 5/1981 | Geberth, Jr. | 239/455 X |

FOREIGN PATENT DOCUMENTS

| | | |
|---|---|---|
| 0 482 369 | 4/1992 | European Pat. Off. . |
| 90/15148 | 12/1990 | WIPO . |

*Primary Examiner*—Andres Kashnikow
*Assistant Examiner*—Steven J. Ganey
*Attorney, Agent, or Firm*—Browdy and Neimark

[57] ABSTRACT

A nozzle device comprises a nozzle (1) having an outlet (2), an inlet (3) and a passage (4) extending between the inlet and outlet. The passage is defined by at least two parts (7, 8), which are movable relative to each other and arranged to be able to be moved away from each other by relative movement so as to widen the passage.

16 Claims, 4 Drawing Sheets

AXIALLY SEPARABLE SELF-CLEANING NOZZLE

FIELD OF THE INVENTION AND PRIOR ART

This invention is related to a nozzle device comprising a nozzle having an outlet, an inlet and a passage extending between the inlet and outlet. The nozzle has, preferably, the character of a jet tube.

The nozzle device according to the invention is generally applicable to all kinds of spray systems where one wishes to spray a liquid for different purposes. The device according to the invention is intended to avoid the serious problem which is caused by tendency to clogging of the liquid passage of the nozzle device.

A particularly preferred application of the nozzle device according to the invention is within fibre processing industries, in particular the paper and cellulose industry. On cleaning of filters within the paper and cellulose industry, one uses water spraying of the filters. The water is then conveyed through a tube, at the end of which a nozzle device is arranged. This nozzle device sprays the water against the filter in a spray stream, which suitable is plate shaped, so as to remove the pulp fibres from the filter.

The water used is per se filtered but contains as a rule some proportion of fibres or other particles tending to clog the passage through the nozzle device. The result is that the water spraying of the filters ceases. In order to clean the nozzle devices, one has to shut off the water supply to the same and dismount the nozzle devices for cleaning. Thereafter the nozzle devices may again be put into place. The disadvantage of these activities is that they require a considerable time and effort and, furthermore, the production is disturbed.

In order to enable cleaning of the nozzle devices during operations, it has been proposed in the Swedish patent No. 463 772 to design the passage in a member which is rotatable in a body of the nozzle device, which enables the passage to be caused, by rotation, to receive a flow of water in the backwards direction. However, the cleaning function in this known embodiment is far from satisfactory apart from the fact that the support of the rotatable member causes a substantial amount of constructive problems.

SUMMARY OF THE INVENTION

The object of the present invention is to provide a nozzle device combining a structurally simple embodiment with an excellent cleaning effect without need for dismounting of the nozzle device. Although the nozzle device in the preferred case is intended for use within the paper and cellulose industry, it is generally applicable in all such connections where nozzles tend to be clogged during operation and where an efficient cleaning function is desired.

The object of the invention is fulfilled by the passage of the nozzle being defined by at least two parts, which are movable relative to each other and arranged to be able to be moved away from each other by relative movement so as to widen the passage.

The solution according to the invention gives rise to an excellent cleaning effect by means of opening or widening of the passage. Possible contaminations deposited in the passage loosen readily and are transported away by the liquid flowing by.

Preferable developments of the invention are defined in the dependent claims.

It is particularly advantageous to make nozzle devices according to the invention form part of a system where one automatically and continuously carries out repeated cleaning actions of the different nozzles by moving their parts defining the passages away from each other, the cleaning times being possible to control by timers or some pressure sensing arrangement, which on reaching of a certain pressure upstreams of the nozzle devices, said pressure indicating clogging of the nozzles, initiates the cleaning actions. Accordingly, interruptions in operation are eliminated, the need for surveillance is reduced, the production is increased and a better profitability is achieved. However, it is also possible to design the nozzle device according to the invention so that it is intended to be manually operated by surveying personal for the purpose of cleaning.

SHORT DESCRIPTION OF THE DRAWINGS

With reference to the enclosed drawings, a more specific description of embodiments of the invention cited as examples will follow hereinafter.

DETAILED DESCRIPTION OF PREFERRED EMBODIMENTS

Figure 1:
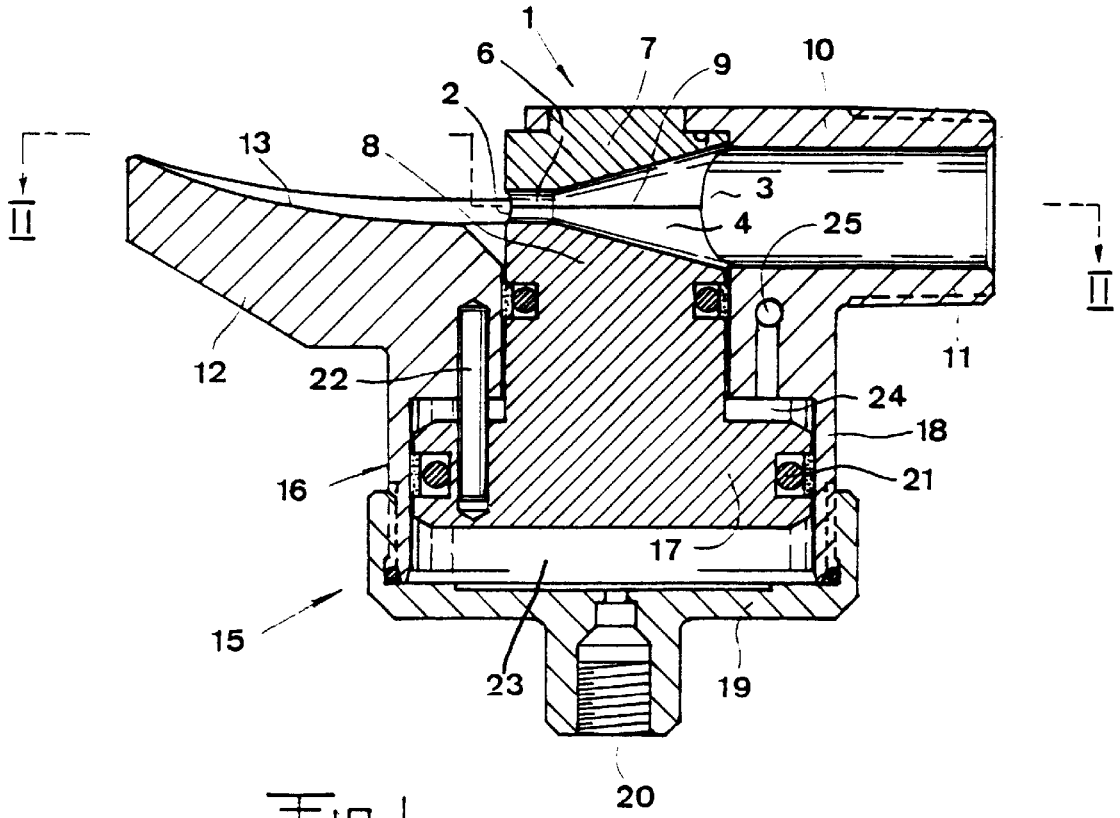
FIG. 1 is a cross sectional of view through the nozzle device according to the invention.
Figure 2:
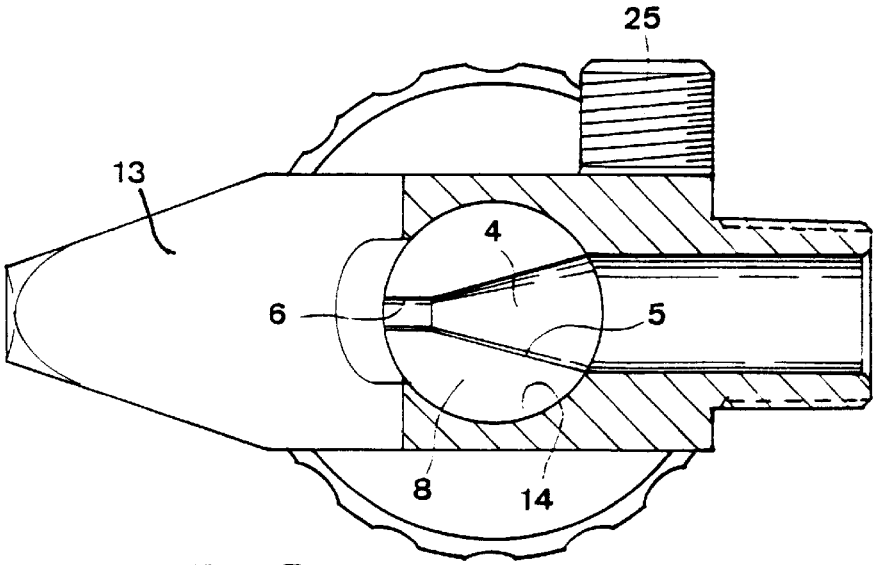
FIG. 2 is a view taken along the line II—II in FIG. 1.
Figure 3:
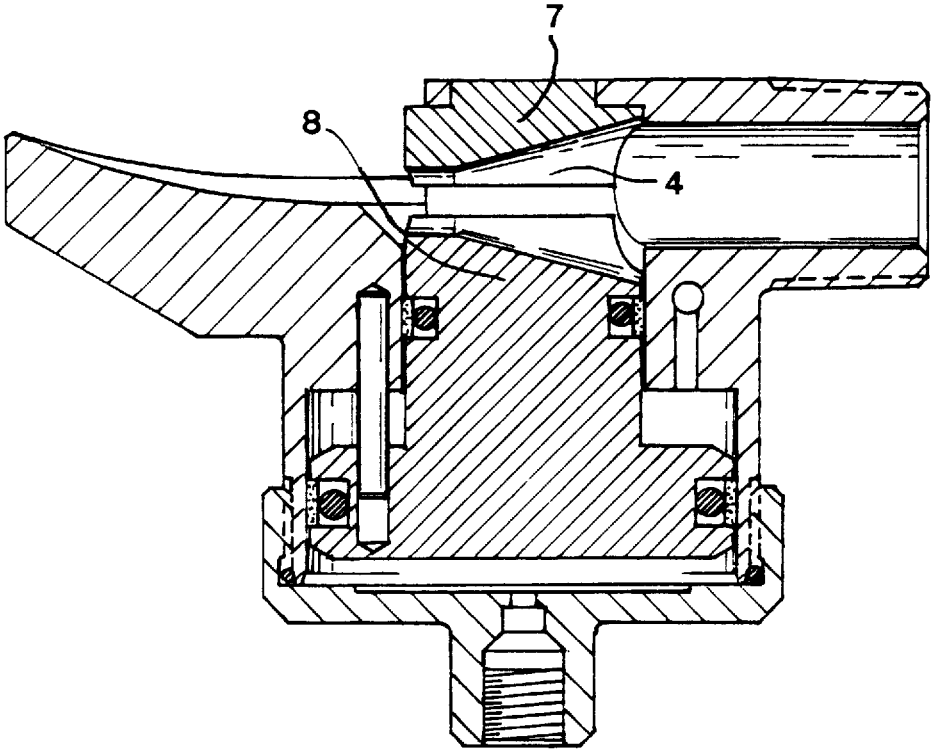
FIG. 3 is a view similar to FIG. 1 but illustrating the nozzle device in another position.

The embodiment according to FIGS. 1–3

The nozzle device in question comprises a nozzle 1 having an outlet 2, an inlet 3 and a passage 4 extending between the inlet and outlet. The nozzle 1 has preferably the character of a jet tube in that the passage 4 at least partially tapers between the inlet 3 and outlet 2. In the example, the passage 4 has a conical portion 5 appearing from FIGS. 1 and 2 and, closest to the outlet 2, a substantially cylindrical portion 6.

The passage 4 is defined by at least two parts 7, 8, which are relatively movable and arranged to be able to be moved away from each other by relative movement so as to widen the cross sectional area of the passage 4. In FIGS. 1 and 2, the passage is illustrated in its normal functional state, in which the parts 7, 8 are abutting against each other so that the passage 4 defines a flow path which is closed sidewardly. The parts 7, 8 preferably abut against each other in a partition plane 9 which is substantially parallel to the longitudinal direction of the passage.

It is illustrated in FIG. 3 that the passage 4 has been widened or opened by movement of the parts 7, 8 away from each other. Accordingly, this means that the cross sectional area of the passage 4 has been increased. It is stressed that movement of the parts 7, 8 away from each other also means that the passage 4 is opened sidewardly since the portions, which in the normal operational state FIG. 1 abut against each other, move away from each other at the side of the passage 4.

The nozzle device comprises a body generally denoted 10. This body comprises means 11 for connection to a liquid supply conduit. Said means 11 has, in the embodiment, the character of an externally threaded tube piece. Furthermore, the body 10 comprises in the area before the outlet 2 of the nozzle a liquid guiding member 12 suitable for shaping the spray stream flowing out through the outlet 2 so that it obtains the character of a plate or curtain. More specifically, that part of the liquid guiding member 12 which is closest to the outlet 2 has the shape of a concave guide surface 13 adapted to divert the spray stream flowing out through the outlet 2.

The parts 7, 8 are in the embodiment movable relative to each other in a substantially rectilinear path of movement. This path extends substantially transversely to the liquid flow path through the nozzle 4.

At least one of the parts 7, 8 is movably received in the body 10 of the device. In the embodiment, the part which is denoted 8 is the one which is movably arranged for the purpose of nozzle cleaning. In this embodiment the other part 7 is conceived to be rigidly connected to the body 10 of the device although the part 7 itself can be formed by a piece separate from the nozzle body 10 proper.

It appears from FIG. 2 that the part 8, as is for the rest also relevant for the part 7, may have a round or circular cross sectional shape viewed perpendicularly to the partition plane 9 and be received in a space 14 which is arranged in the body 10 and has a substantially circular cross section. However, also other cross sectional shapes are basically possible.

The moveable part 8 of the nozzle is arranged to be put into motion by means of a power exerting arrangement 15. This is in the embodiment formed by a piston cylinder mechanism comprising a cylinder generally denoted 16 and a piston 17. More specifically, the part 8 is connected to the piston 17 of the mechanism 15. The part 8 may, more specifically, be designated as a piston rod since it is capable of moving back and forth in the recess 14 arranged in the nozzle body 10.

The cylinder 16 of the mechanism 15 is at least partially formed by the body 10 of the device. More specifically, the cylinder is formed by a mantle 18 associated to the body 10 and a gable 19 arranged at the mantle 18. This gable has, suitably, the character of a cover securable to the mantle 18; the securing may for instance occur by means of a thread connection. The cover 19 comprises preferably, a pressure fluid connection 20.

The piston 17 is slidably received in the space defined by the cylinder 16 and has conventional sealings 21. Means 22 are provided for restricting the piston 17, and accordingly the part 8, from rotating in the cylinder. Said means 22 may for example have the character of a guide pin secured in the body 10 and slidably received in a hole in the piston 17.

The pressure fluid connection 20 arranged in the gable 19 opens to a working chamber 23 on one side of the piston 17. On the other side of the piston there is a further working chamber 26, which communicates with a second pressure fluid connection 25.

When the device described is in operation, the working chamber 23 is pressurised so that the parts 7, 8 are caused to abut against each other while defining a passage 4 located between the parts and adapted for the liquid in question. For avoiding clogging of the passage 4, said clogging starting, as a rule, at the most narrow part 6 of the passage, the working chamber 24 of the piston cylinder mechanism is instead pressurised so that the second working chamber 23 is evacuated. The part 8 then moves downwardly as illustrated in FIG. 3, which gives rise to the parts 7, 8 moving away from each other while opening or widening the passage 4. This opening or widening means that collections of fibres or other contaminations in the passage 4 are efficiently loosened and transported away by means of the liquid flow which is intended to pass between the parts 7, 8 during the cleaning action.

When the cleaning has been terminated, the working chamber 23 is again pressurised so that the parts 7, 8 are caused to abut against each other according to FIGS. 1 and 2.

Figure 4:
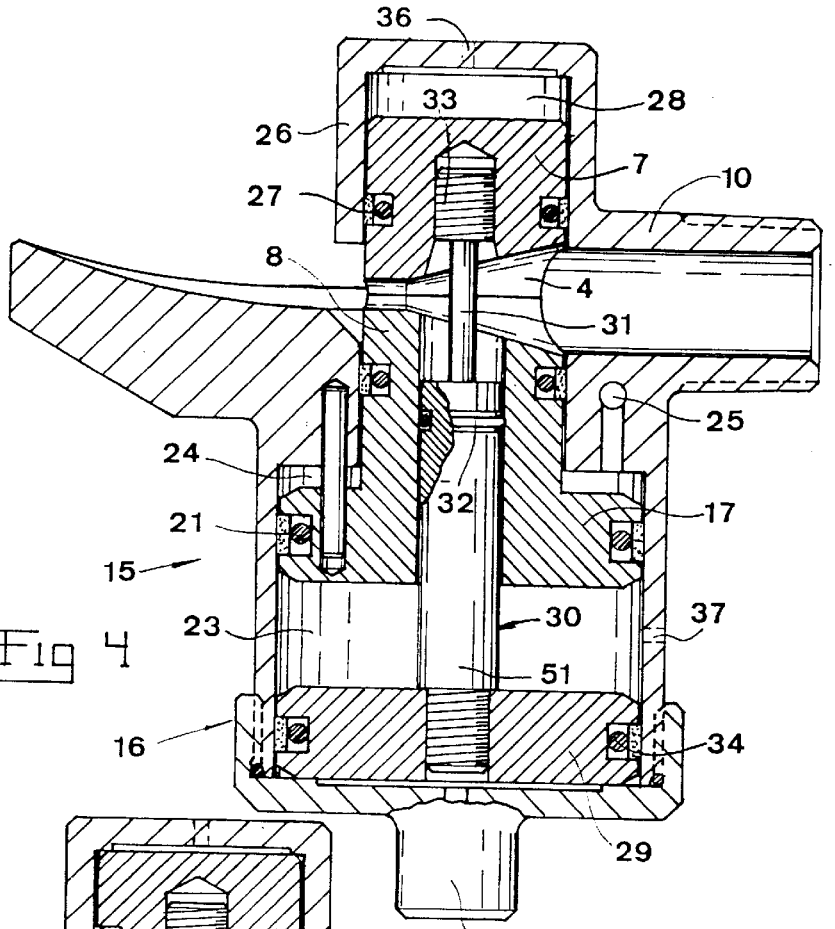
FIG. 4 is a view similar to FIG. 1 but illustrating an alternative embodiment of the nozzle device.
Figure 5:
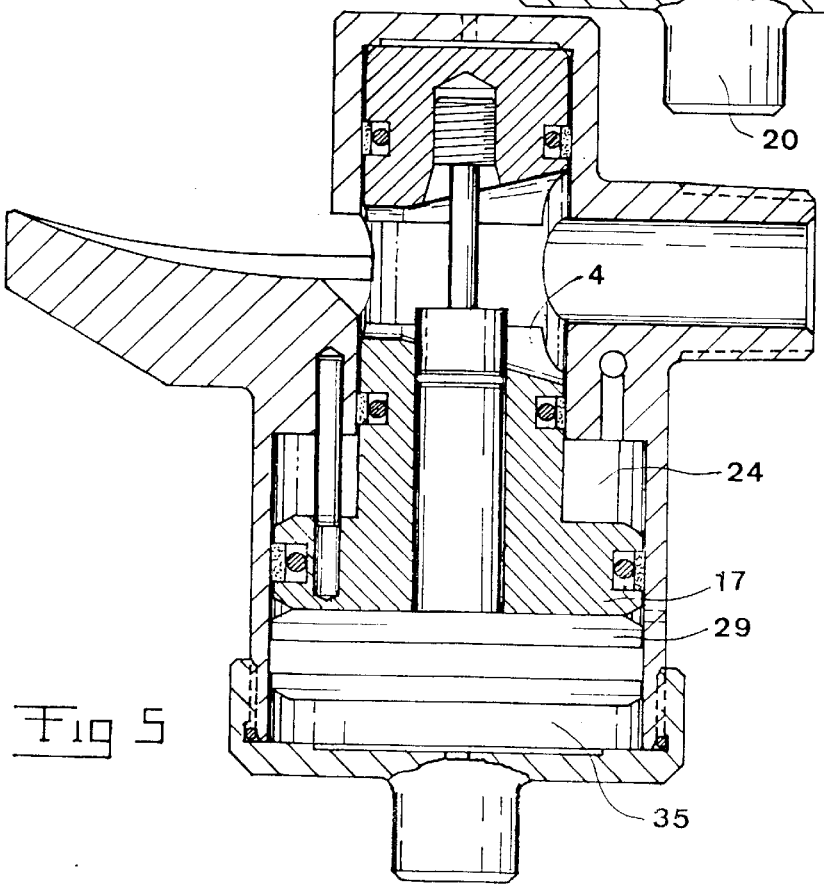
FIG. 5 is view similar to FIG. 4 but illustrating an other position of the nozzle device.

The embodiment according to FIGS. 4 and 5

As far as possible, like reference characters as in the preceding embodiment is used here for analogous or similar components.

In this embodiment both parts 7, 8 are movable relative to the body 10 of the device. As previously, the part 8 is connected to a piston 17 of a piston cylinder mechanism 15 movable in a cylinder 16.

The part 7 is here movably received in a cylinder 26, which is formed in the body 10 of the device or possibly by means of a component attached thereto. The part 7 obtains the character of a piston since it is movable in the interior of the cylinder 26, said interior forming a working chamber 28, the piston being sealed by means of sealing members 27.

Apart from the fact that the part 7 itself forms a piston belonging to the cylinder 26, the part 7 is connected to a further piston 29, which is movable in the same cylinder 16 as the first mentioned piston 17. More specifically, a piston rod 30 of the piston 29 extends through the piston 17 and the part 8 into a connecting engagement with part 7. The piston rod 30 will in the example pass through the passage 4. In order to obtain a minimum of disturbance of the flow in the passage 4, the piston rod 30 suitably has a relatively slim portion 31 in the area of the passage 4 and a wider guiding portion 51 engaging with a through-hole through the piston 17 and part 8. A sealing 32 functions to seal between the piston rod 30 and the piston 17. The connection between the piston rod 30 and the part 7 may for instance be realised by means of a thread connection at 33.

The piston 29 is sealed relative to the cylinder 16 by means of sealing members 34.

The piston or part 7 is prevented from rotating relative to the body 10.

In this embodiment the working chamber 23 will be located between the two pistons 17, 29. A further working chamber 35 is present on that side of the piston 29 which is turned away from the piston rod 30.

In normal operation, i.e. when the passage 4 has its smallest width and is sidewardly closed, the working chamber 28 is pressurised via connection 36 so that the part 7 is present in its lower position with the working chamber 35 at a minimum and the piston 29 in its end position. At the same time, the working chamber 23 between the pistons 17 and 29 is pressurised via a connection 37 so that the piston 17 is actuated upwardly and the piston 29 downwardly and the parts 7 and 8 will abut against each other. Accordingly, the pressurised fluid in the working chamber 23 influences the parts 7 and 8 against each other, whereas the pressurised fluid in the working chamber 28 defines the position of the parts 7, 8 opposite to the inlet channel to the passage 4.

When cleaning of the nozzle passage 4 is to be carried out, the working chambers 23 and 28 are instead coupled to evacuation and pressurisation occurs of the working chambers 24 and 35, which will give rise to the pistons 17 and 29 moving in a direction towards each other and instead the parts 7 and 8 in a direction away from each other while widening or opening the passage 4.

Figure 6:
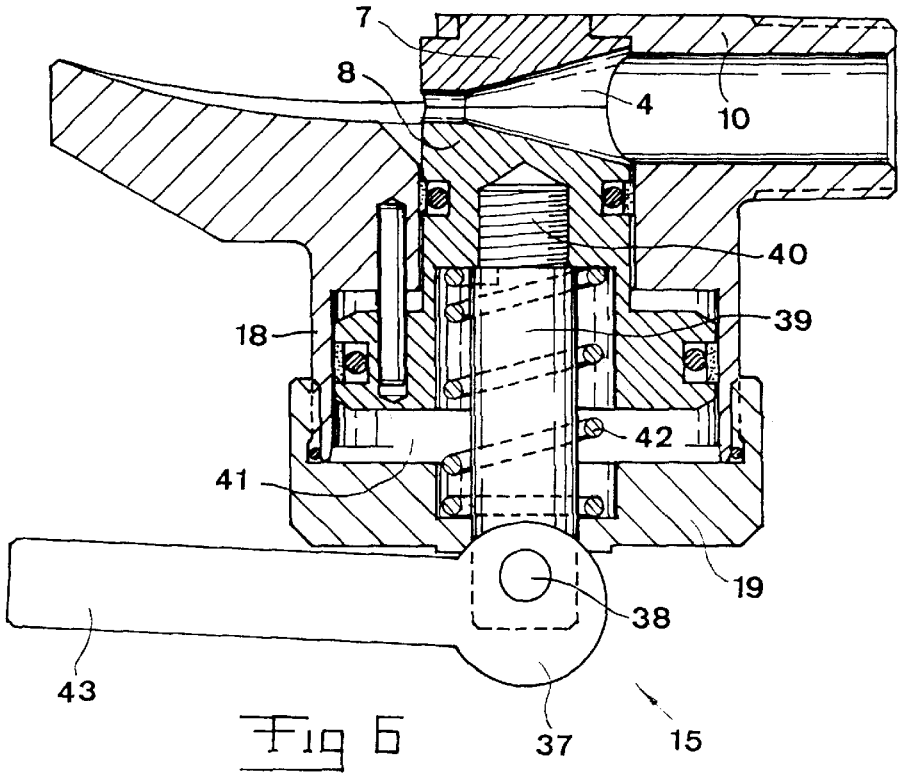
FIG. 6 is view similar to FIG. 1 but illustrating a different embodiment.
Figure 7:
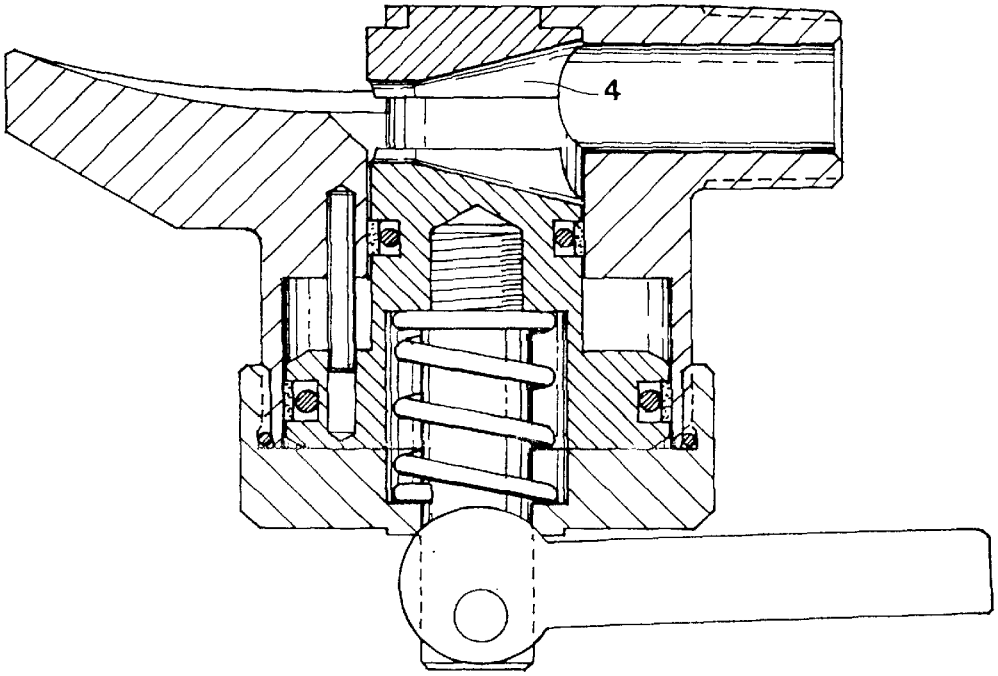
FIG. 7 is a view similar to FIG. 6 but illustrating another position of the device.

The embodiment according to FIGS. 6 and 7

This embodiment corresponds to the embodiment according to FIGS. 1–3 in all aspects except as far as the power exerting arrangement is concerned, which here instead comprises an eccentric 37, by means of which such forces may be placed on the nozzle part 8 that it is moved away from the other part 7 rigidly connected to the body 10 of the device. More specifically, the eccentric 37 is pivotably supported about an axle 38 relative to an element 39, which in its turn is connected to the part 8, for instance via a thread connection 40. The element 39 passes out of the body of the device via an opening therein, for instance in a cover 19 arranged thereon, said cover defining, in cooperation with the mantle 18, a space 41 in the body 10, in which space the element 39 is present.

Resilient means 42 serves for actuating the part 8 against the part 7 so that the passage 4 obtains its smallest cross section. In the embodiment, the resilient means 42 is formed by a screw spring disposed about element 39 and acting with one of its ends against the body 10, for instance the cover 19 thereof, and with its other end against the part 8.

A handle 43 is connected to the eccentric 37. The eccentric is intended to abut against a portion of the body 10 with its eccentrical periphery, said portion being in the example the cover 19 of the body, pivoting of the eccentric 37 about the axle 38 by means of the handle 43 giving rise to movement of the part 8 away from and towards respectively the other part 7.

In normal operation, the eccentric 37 is in the position according to FIG. 6 so that the resilient means 42 may press the part 8 against the other part 7, the passage 4 then having its smallest width.

On cleaning, the eccentric 37 is operated by means of the handle 43 to the position according to FIG. 7, the part 8 being moved away from the part 7 while widening or opening the passage 4, cleaning of the same then occurring.

MODIFICATIONS OF THE INVENTION

The embodiments illustrated purely as examples may of course be modified in several ways within the frame work of the inventive concept. As an example it is pointed out that it would be possible to design the nozzle device so that its passage 4 was defined by more than two relatively movable parts, said parts being arranged to be moved away from each other and towards from each other respectively through movement in a radial direction relative to the longitudinal axis of the passage 4.

It is pointed out that the power exerting arrangement 15 may be of another type than mechanical or pressure fluid actuated. Thus, electrical power exerting arrangements may for instance be used. Generally speaking, its emphasised that the device according to the invention in a preferred embodiment is arranged so that the power exerting arrangement is adapted to exert power for widening the passage independently of pressure and flow conditions of the liquid which shall pass through the nozzle device, i.e. that the power exerting arrangement shall be designed to obtain such external power supply, manually or via power supply members, that the movable parts defining the passage shall be possible to be imparted their relative movement independently of whether there is a high or low pressure in the passage through the nozzle device or upstream of the passage. In fact, it is particularly advantageous that the power exerting arrangement is adapted to be capable of widening the passage also when their is a normal liquid operation pressure or even a liquid pressure which is higher than this normal pressure in the nozzle device or upstream thereof.

I claim:

1. A nozzle device comprising a liquid spraying nozzle (1) including an outlet (2), an inlet (3) and a liquid nozzle passage (4) extending between the inlet and the outlet, said passage (4) being defined by at least two tapering nozzle parts (7,8) movable relative to each other, said parts being adapted to be moved away from each other by a relative movement so as to widen the passage, at least one of the parts (7,8) being movably received in a body (10) of the device, wherein the parts (7,8) are movable relative to each other in a substantially rectilinear path of movement, the rectilinear path extending substantially transversely to the liquid flow path through the nozzle (4);

wherein at least one of the parts (7,8) is movable by a power-exerting mechanism (15) adapted to exert power for widening the passage independently of pressure and flow conditions of the liquid passing the nozzle.

2. A device according to claim 1, characterized in that the nozzle (1) has the character of a jet tube since the passage (4) at least partially tapers between the inlet (3) and the outlet (2).

3. A device according to claim 1, characterized in that the power exerting mechanism (15) comprises a piston cylinder mechanism (16, 17; 16, 29).

4. A device according to claim 3, characterized in that the at least one part is connected to the piston (17, 29) of the piston cylinder mechanism.

5. A device according to claim 3, characterized in that the cylinder (16) of the piston cylinder mechanism is at least partially formed by the body (10) of the device.

6. A device according to claim 1, characterized in that the two parts (7, 8) both are movable relative to the body (10) of the device.

7. A device according to claim 6, characterized in that both parts (7, 8) are movable by power exerting mechanism comprising piston cylinder mechanisms.

8. A device according to claim 7, characterized in that pistons (17, 29) of the piston cylinder mechanisms are movable in one and the same cylinder (16).

9. A device according to claim 7, characterized in that a piston rod (30) of a first of the piston cylinder mechanisms extends through the piston (17) of a second of the mechanisms.

10. A device according to claim 1, characterized in that the power exerting mechanism comprises an eccentric (37).

11. A nozzle device according to claim 1, wherein the nozzle passage (4) includes a conical portion.

12. A nozzle device according to claim 1, wherein the nozzle passage (4) includes a cylindrical portion.

13. A nozzle device comprising a liquid spraying nozzle (1) including an outlet (2), an inlet (3) and a liquid passage (4) extending between the inlet and the outlet, said passage (4) being defined by at least two parts (7,8) movable relative to each other, said parts being adapted to be moved away from each other by a relative movement so as to widen the passage, at least one of the parts (7,8) being movably received in a body (10) of the device, wherein the parts (7,8) are movable relative to each other in a substantially rectilinear path of movement, the rectilinear path extending substantially transversely to the liquid flow path through the nozzle (4);

wherein both of the parts (7,8) are movable by power-exerting mechanisms.

14. A device according to claim 13, wherein the power-exerting mechanisms comprise piston-cylinder mechanisms.

15. A device according to claim 14, wherein pistons of the piston-cylinder mechanisms are movable within a single cylinder (16).

16. A device according to claim 15, wherein a piston rod (30) of a first one of the piston-cylinder mechanisms extends through a piston of a second one of the piston-cylinder mechanisms.

* * * * *